US005489411A

United States Patent [19]

Jha et al.

[11] Patent Number: 5,489,411

[45] Date of Patent: Feb. 6, 1996

[54] TITANIUM METAL FOILS AND METHOD OF MAKING

[75] Inventors: Sunil C. Jha, Attleboro, Mass.; James A. Forster, Barrington; Robert W. Howard, Pawtucket, both of R.I.

[73] Assignee: Texas Instruments Incorporated, Dallas, Tex.

[21] Appl. No.: 763,843

[22] Filed: Sep. 23, 1991

[51] Int. Cl.[6] ..... B22F 5/00

[52] U.S. Cl. ..... 419/3; 419/5; 419/28; 419/29; 419/43; 419/50; 419/56; 419/57; 29/17.1; 29/17.2; 29/17.3; 428/607

[58] Field of Search ..... 419/1, 3, 5, 6, 419/7, 8, 9, 28, 29, 43, 50, 56, 57; 29/17.1, 17.2, 17.3; 428/607

[56] References Cited

U.S. PATENT DOCUMENTS

| | | | |
|---|---|---|---|
| 2,879,587 | 3/1959 | Mushovic et al. | 29/488 |
| 3,095,500 | 6/1963 | Jost | 219/117 |
| 3,104,135 | 9/1963 | Morrison et al. | 308/237 |
| 3,276,103 | 10/1966 | Kopke et al. | 29/149.5 |
| 3,421,972 | 1/1969 | Cromwell et al. | 161/189 |
| 4,141,482 | 2/1979 | Reynolds | 228/158 |
| 4,622,189 | 11/1986 | Bellis et al. | 264/112 |
| 4,775,547 | 10/1988 | Siemers | 427/34 |
| 4,782,884 | 11/1988 | Siemers | 164/46 |
| 4,786,566 | 11/1988 | Siemers | 428/568 |
| 4,805,294 | 2/1989 | Siemers | 29/527.7 |
| 4,805,833 | 2/1989 | Siemers | 228/190 |
| 4,816,347 | 3/1989 | Rosenthal et al. | 428/615 |
| 4,978,585 | 12/1990 | Ritter et al. | 428/614 |

*Primary Examiner*—Donald P. Walsh
*Assistant Examiner*—Chrisman D. Carroll
*Attorney, Agent, or Firm*—Russell E. Baumann; Richard L. Donaldson; René E. Grossman

[57] ABSTRACT

A high strength titanium alloy or titanium aluminide metal foil having improved strength and density is produced, preferably in coilable strip form, by plasma-depositing the selected titanium-based material on a receiving surface, separating the deposited material from the receiving surface to provide two metal foil preforms each having a relatively smooth side as cast against the receiving surface and a relatively rough, opposite side as deposited from the plasma, disposing the two metal preforms together with the relatively rough sides of the two metal preforms in facing engagement with each other, and squeezing the two preforms together between pressure bonding rolls to metallurgically bond the preforms to each other and to consolidate the materials of the preforms to form a fully dense metal foil.

7 Claims, 5 Drawing Sheets

50X
200uM 50X
200uM 100X
100uM 100X
100uM 400X
25uM 400X
25uM

TITANIUM METAL FOILS AND METHOD OF MAKING

BACKGROUND OF THE INVENTION

The field of the invention is that of metal foil materials and the invention relates more particularly to foils of high strength titanium alloys and titanium aluminides and the like and to methods for manufacturing foils of such materials.

Composite materials of titanium aluminides reinforced with silicon carbide fibers have been proposed for use in aerospace applications. Such composite materials display high strength at elevated temperatures. Other high strength titanium alloys are also proposed for use in metal matrix composites and in honeycombs and the like. If titanium aluminide or titanium alloy foils could be manufactured at reasonable cost with consistently high strength characteristics, they would find wide application in fabricating metal matrix composites and honeycombs.

However, due to their ordered crystal structures, titanium aluminides based on the $Ti_3Al$ (alpha two) and TiAl (gamma) intermetallic compounds possess limited cold and hot workability. Other high strength titanium alloys also have limited ductility. Accordingly it has been difficult to produce foils of such materials from ingot form by a succession of conventional rolling and annealing steps or the like, and low process yields using such procedures substantially increase the cost of such foils. Further, such materials usually have required cross-rolling to avoid development of undesirable textures in the materials so that it has frequently not been possible to obtain substantial lengths of coiled foil materials for use in fabricating composites or honeycombs or the like in an inexpensive manner. Recently it has been proposed that titanium alloy or titanium aluminide foils be formed by plasma deposition of such materials on a receiving surface as shown in U.S. Pat. No. 4,775,547, U.S. Pat. No. 4,782,884, U.S. Pat. No. 4,786,566, U.S. Pat. No. 4,805,294, U.S. Pat. No. 4,805,833 and U.S. Pat. No. 4,978,585. After peeling such deposited materials from the receiving surface, the peeled strip has been passed between pressure rolls to be consolidated and reduced to a desired foil thickness. However those known plasma-deposited materials are found to display less than satisfactory density as deposited and tend to be subjected to cracking and the like as they are consolidated by pressure rolling so that they tend to display less than fully desired density and strength when placed in actual use.

It would be desirable if titanium aluminide and high strength titanium alloy foils and the like could be produced in coiled, continuous strip form for use either in monolithic form or in titanium-based composite materials and honeycombs and the like while also being adapted to display desirable high strength, high density and freedom from cracking.

BRIEF SUMMARY OF THE INVENTION

It is an object of the invention to provide novel and improved metal foils; to provide high strength titanium alloy foils and titanium aluminide foils having novel and improved characteristics; to provide such foil materials which display substantially full density; and to provide novel and improved methods for making such improved metal foils.

Briefly described, the novel and improved foil materials of the invention comprise titanium aluminide foils and foils of high strength titanium alloys which are made by plasma-depositing such materials on a substrate or receiving surface, peeling the deposited materials from the substrate or receiving surface to provide two metal foil preforms each having a relatively smooth side as cast or formed against the receiving surface and a relatively rough, opposite or free side as deposited from a plasma, and pressure squeezing the metal foil preforms together with the rough sides thereof in facing engagement with each other so that the metal foil preforms are sufficiently reduced in thickness to be metallurgically bonded to each other and so that the materials of the two metal preforms are consolidated with each other, thereby to provide a metal foil of improved density and strength.

In a preferred embodiment of the invention, the selected metal material is plasma-deposited on a receiving surface or substrate comprising a continuous belt rotatably driven around a pair of supporting rollers and the deposited material is continuously peeled from the receiving surface to form a coil of metal foil preform of desired length. After heat-treatment for removal of residual stresses, two coils of such metal foil preform material are fed from pay-off reels with the relatively rough sides thereof in facing relation to pass between pressure bonding rolls to be metallurgically bonded to each other and to be consolidated with each other. In another preferred embodiment of the invention, the metal foil preforms are plasma-deposited and continuously peeled from a pair of such continuous belts at a pair of stations, are heat-treated in-line with those stations, and are then advanced together between pressure bonding rolls at room temperature in an air or protective atmosphere to be metallurgically bonded to each other and to be consolidated with each other, also in-line with the plasma-deposition stations.

In a preferred embodiment of the invention, the metal foil preforms as-deposited are subjected to heat-treatment in a vacuum or in an argon or other non-oxidizing or non-reacting protective atmosphere to remove the residual stresses from the plasma-deposited preforms prior to being passed between the pressure bonding rolls, and subsequently the metallurgically-bonded and consolidated metal foil is solution annealed in a corresponding atmosphere after the metallurgical bonding to produce desired fine grain materials of high ductility. The noted heat-treatments are performed either in-line or in separate batch steps as preferred. The metal foil materials as thus formed are further cold rolled with intermediate anneals as desired to produce a desired final foil thickness. The foils are found to display substantial ductility and to display substantially one hundred percent of theoretical density while displaying consistent high strength free of external or internal cracks, holes, and other blemishes so that the foils are equally adapted for use in monolithic form or in fabricating metal matrix composites and honeycombs and the like.

DESCRIPTION OF THE DRAWINGS

Other objects, advantages and details of the novel and improved titanium foil materials and methods of the invention appear in the following detailed description of preferred embodiments of the invention, the detailed description referring to the drawings in which.

DESCRIPTION OF THE PREFERRED EMBODIMENTS

Figure 1:
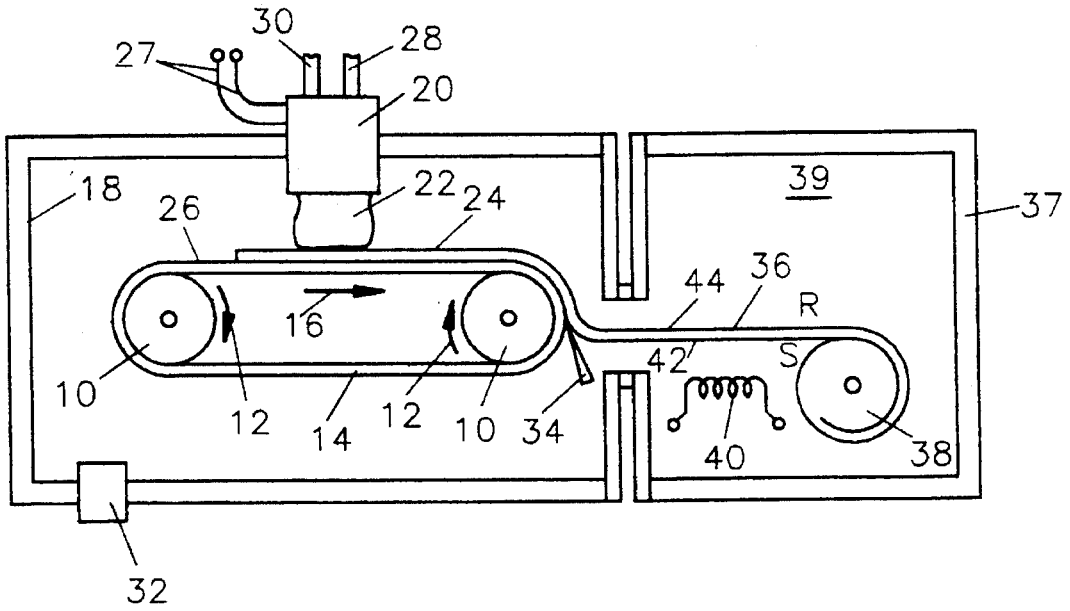
FIG. 1 is a diagrammatic view illustrating a first stage in a preferred embodiment of the method for making foil materials as provided by the invention.

Referring to the drawings, in making the novel and improved titanium aluminide or high strength titanium alloy foil of the invention, a pair of rollers 10 are arranged to rotate as indicated by the arrows 12 and a continuous or endless belt or substrate 14 formed of a thin, pliable strip of molybdenum, mild steel or stainless steel or the like is arranged on the rollers to be continuously driven on the rollers in any conventional manner as indicated by the arrow 16. The rollers are arranged within a conventional vacuum chamber 18, and a plasma spray gun 20 of any conventional type is mounted in the chamber to provide a plasma 22 for depositing titanium aluminide or high strength titanium alloy metal material or the like 24 on a smooth, receiving surface 26 on the substrate in a conventional way. Preferably the plasma spray gun comprises a conventional RF plasma spray apparatus which is particularly adapted for plasma-depositing titanium aluminide intermetallic compounds or high strength titanium alloys, such an apparatus typically including conductive, tubular power input means 27 to be connected to an RF power supply and which typically also furnish coolant to the plasma spray gun, a tube means 28 for furnishing a stream of a gas or a combination of gases such as argon or helium into the chamber 18, and a tube 30 for furnishing a stream of powder metal particles entrained in a carrier gas into the plasma 22 to be melted and deposited on the receiving surface 26. Preferably the metal powders are provided with particle sizes in the range of –4 to 200 mesh sizes to assure free flow and deposit of metal on the surface 26 while avoiding excessive contamination of the deposit with absorbed gases and the like. The chamber 18 is provided with vacuum pump means 32 to maintain a desired vacuum in a chamber during operation of the plasma spray gun.

The metal deposit 24 is then separated from the substrate in any conventional manner. Typically, a wedge means or the like as diagrammatically indicated at 34 is arranged for peeling the plasma-deposited metal material 24 from the receiving surface 26 to provide a metal foil preform 36 which, in a preferred embodiment of the invention, is coiled on a take-up reel 38 in any conventional manner. Typically the preform as removed from the receiving surface has an overall thickness in the range from about 0.010 to 0.020 inches. The preform material is subjected to a heat-treatment after it is separated from the receiving surface 26 to remove residual stresses resulting from the deposition and separation. Preferably the metal preform is heated in-line in a vacuum or in an inert gas atmosphere 39 in a chamber 37 as is diagrammatically indicated at 40 in FIG. 1. In such case, the strip of titanium aluminide or high strength titanium alloy metal foil preform is preferably heated to a temperature in the range from about 900° to 1100° C. for 1 to 2 minutes to remove the residual stresses. Alternately, the heat-treatment for stress removal is performed in an annealing oven with a corresponding atmosphere after coiling of the preform material and before use of the coiled material in subsequent steps of the method of the invention. In such a case, the coiled material is preferably heated in the temperature range from 900° to 1100° C. for 10 to 60 minutes. The preform is typically formed in widths from a few inches up to 36 inches wide.

Figure 3:
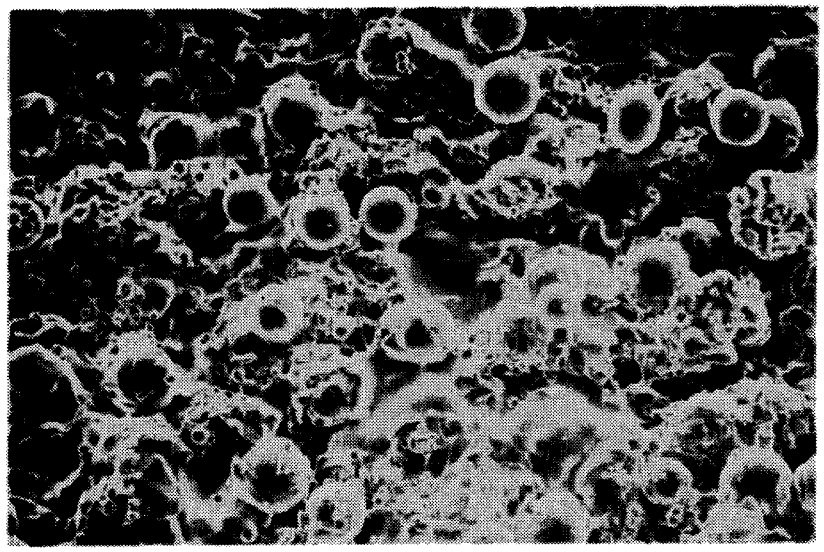
FIG. 3 is a photomicrograph of one side surface of a plasma-deposited metal foil preform produced in the method of FIG. 1.
Figure 4:
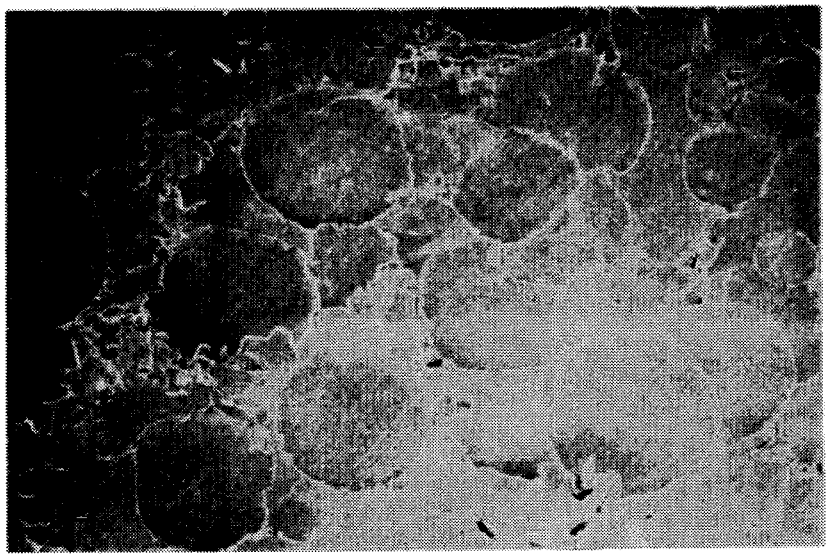
FIG. 4 is a photomicrograph of an opposite side surface of a metal foil preform of FIG. 3.
Figure 5:
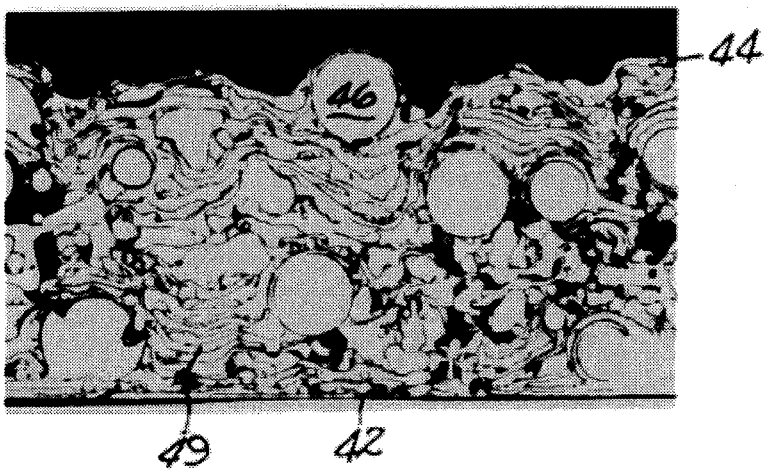
FIG. 5 is a photomicrograph of a section taken along a longitudinal axis of the metal foil preform shown in FIGS. 3 and 4.

As formation of the plasma-deposited metal foil preform 36 is generally conventional as described in U.S. Pat. No. 4,775,547, U.S. Pat. No. 4,782,884, U.S. Pat. No. 4,786,566, U.S. Pat. No. 4,805,294, U.S. Pat. 4,805,833, and U.S. Pat. No. 4,978,585, the disclosure of which are incorporated herein by this reference, the plasma-deposition and the separating of the metal foil preform from its receiving surface are not further described herein and it will be understood that one side surface 42 of the metal foil preform as cast or deposited against the receiving surface 26 is relatively smooth while the opposite or free side surface 44 of the preform as deposited from the plasma 22 is relatively rough. Typically for example, the as-cast surface 42 of a titanium aluminide preform has a smoothness as illustrated at magnifications of 50X and 100X respectively in the photomicrographs of FIGS. 4 and 5 whereas the relatively rough side 44 of the preform has a surface roughness as indicated at comparable magnification in FIGS. 3 and 5. Typically also the metal foil preform incorporates some grains of a titanium aluminide or high strength titanium alloy powder material which are not fully melted or are even substantially unmelted in the preform as is indicated at 46 in FIG. 5. The unmelted particles show an acicular phase while the materials which had melted and resolidifed as indicated at 49 display a finer microstructure resulting from rapid solidification. It should also be understood that although a specific procedure for plasma deposition of the preform 36 is described herein, plasma-deposited metal foil preforms are available commercially and are also useful in the process of this invention, such a preform material of corresponding properties being available from Textron Specialty Materials of Lowell, Mass., for example.

Figure 2:
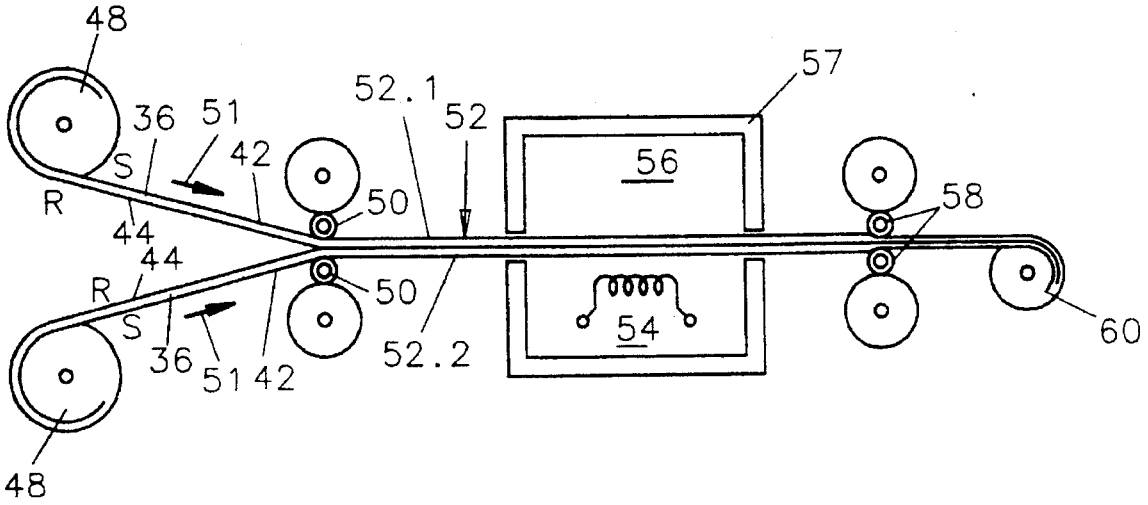
FIG. 2 is a diagrammatic view illustrating a second and final stage in the method of FIG. 1 for producing the novel and improved metal foils of the invention.
Figure 6:
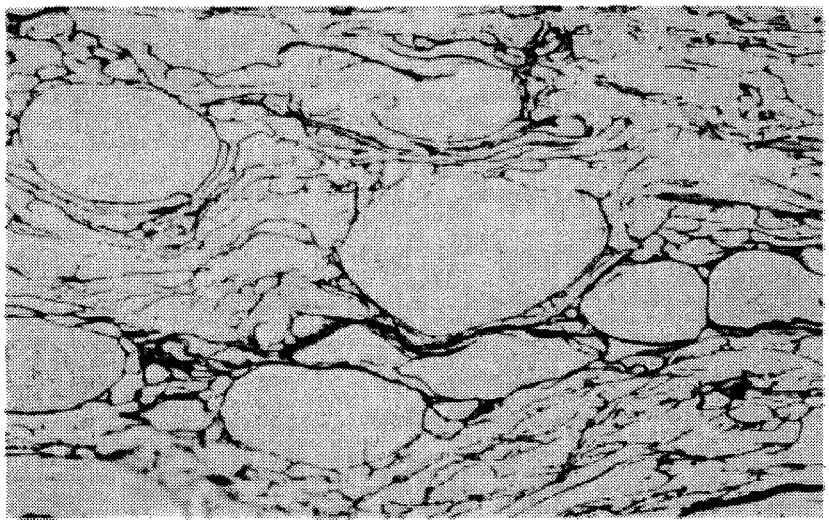
FIG. 6 is a photomicrograph of a section taken along a corresponding longitudinal axis of the metal foil produced according to the method of FIGS. 1 and 2.
Figure 7:
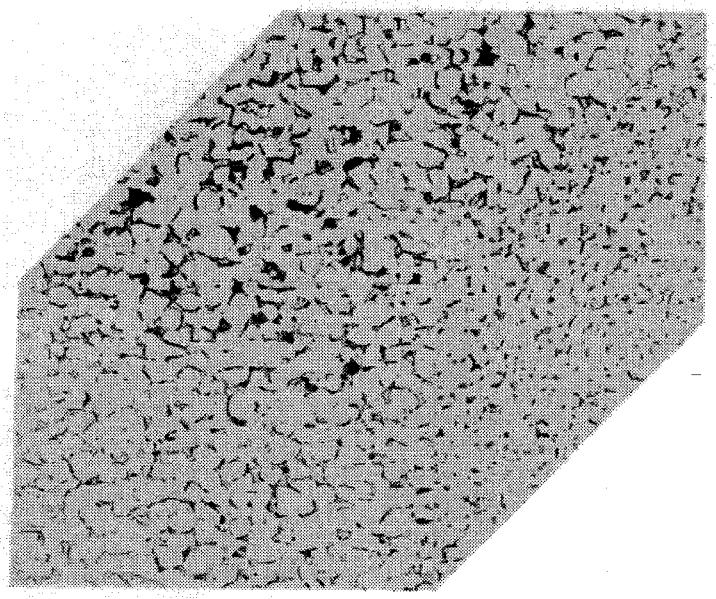
FIGS. 7–8 are somewhat diagrammatic representations of preferred embodiments of the metal foil metal material of the invention and of a wrought metal foil produced by conventional ingot metallurgy respectively, the structures as shown representing portions of the foil materials as viewed in perspective.
Figure 8:
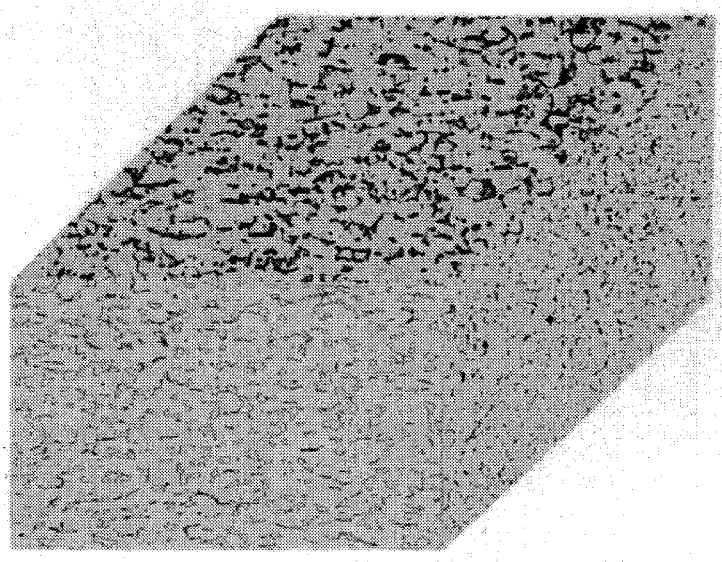

In accordance with the method of the invention, two metal foil preforms as thus described are brought together with the relatively rough side surfaces of the two preforms in facing engagement with each other and are pressed together with sufficient force to metallurgically bond the materials of the two preforms to each other and simultaneously to consolidate the preform materials to provide a metal foil having improved strength and density characteristics. Preferably for example, two metal foil preforms 36 are advanced from respective pay-off reels 48 as shown by arrows 51 in FIG. 2 so that the relatively rough side surfaces 44 of the respective preforms are engaged. The two preforms are then passed between a pair of pressure bonding rolls 50 of any conventional type at room temperature in an air atmosphere or the like and are pressed or squeezed together with sufficient force to metallurgically bond the preform materials to each other to form a dense metal foil 52. Preferably the pressure bonding rolls comprise conventional four-high pressure bonding rolls of a Zendzimer mill or the like and preferably the two preform materials are reduced in overall thickness by about 15 to 25 percent as the rough surfaces thereof are interlocked and joined by solid phase metallurgical bonds. The metal foil is typically warmed about 100° F. during such pressure reduction. In that way spalling of any loosely adhering metal particles 46 or the like appearing on the relatively rough side surfaces 44 of the preforms tend to be avoided and such materials are captured in the metal foil preform rather than being dislodged from the preforms. Further, asperities appearing on the relatively rough side surface of one preform tend to nest within corresponding depressions in the rough side surface of the other preform to facilitate consolidating of the preform materials, thereby to result in a substantially fully densified metal foil 52 as illustrated in FIG. 6. Cracking of the metal foil such as might typically originate at an edge crack or pore of one preform is largely avoided resulting in improved and more consistent foil strength properties. On the other hand, the pressure bonding rolls 50 are engaged only by the relatively smooth side surface 42 of the preforms as the preform materials are squeezed between the rolls to avoid roll marring and to facilitate accurate reduction in thickness of the preform materials as they are metallurgically bonded together at or near room temperature. In that way, the unmelted metal grains 46 present in the preforms 26 are elongated and compactly accommodated in the metal foil 52 and the metal foil is characterized by two, smooth, as-originally-cast outer side surfaces 52.1, 52.2. The metal foil 52 as bonded is preferably solution annealed as diagrammatically indicated at 54 within a chamber 57 having a vacuum or inert gas atmosphere as indicated at 56 in FIG. 2. Typically for example, a metal foil 52 of titanium aluminide or high strength titanium alloy materials is solution annealed at a temperature of about 900° to 1150° C. for 1 to 2 minutes in-line as indicated in FIG. 2. Preferably the metal foil is solution heat-treated below the beta transus temperature and is cooled in the furnace or annealing oven. If batch solution annealing is done, the metal foil 52 is preferably heated at a corresponding temperature for 10 to 60 minutes. In the heat treatment, oxide layers on particle surfaces in the preforms tend to dissolve into the metal materials and recrystallization occurs across interfaces of particles from the respective preforms. On slow cooling from the solution heat-treat temperature, a duplex microstructure appears to result, the finer acicular alpha phase of the unmelted grains 46 changing to coarser platelets while the remaining material is converted to equiaxed alpha phase material with an intergranular beta phase. The materials of the metal foil are relatively fine grained and display substantial ductility. Preferably the metal foil 52 is reduced in thickness by about 10 percent per cold rolling pass between rolls of a conventional rolling mill as indicated diagrammatically at 58 in FIG. 2 and is easily coiled on a take-up reel 60. Typically the metal foil is reduced several times with intermediate solution anneals to provide a metal foil 52 of 0.005 inch thickness or less. In that arrangement, the metal foil 52 achieves substantially complete theoretical density as is illustrated for a high strength titanium alloy in FIG. 7 and substantially corresponds in structure and density with a wrought metal foil of the same composition prepared by conventional ingot metallurgy as illustrated in FIG. 8. The metal foil is of symmetrical structure permitting such repeated rolling without development of undesirable textures or requiring cross-rolling so that the metal foil displays improved strength, density and ductility. If desired the two metal preforms which are bonded together embody selected different titanium-based materials so that the foil 52 comprises a composite metal foil having combined properties of the two selected materials.

In a variant of that process, a single convolution of a plasma-deposited preform can be prepared on a drum or reel and can be removed from the drum to provide a single convolution coil with a rough outer surface and a smooth inner surface. Two of such coils are prepared. After a first heat-treatment corresponding to the final heat treatment described above the coils are flattened into sheets, the sheets are roll bonded together with the rough sheet surfaces engaged, the bonded composite material is further heat-treated as in the previous process, and the material is cold-rolled to size to provide the desired dense foil. That is, this variant differs from the previously described process in beginning with single revolution coils flattened to sheet form in or after the first heat treatment step.

Figure 9:
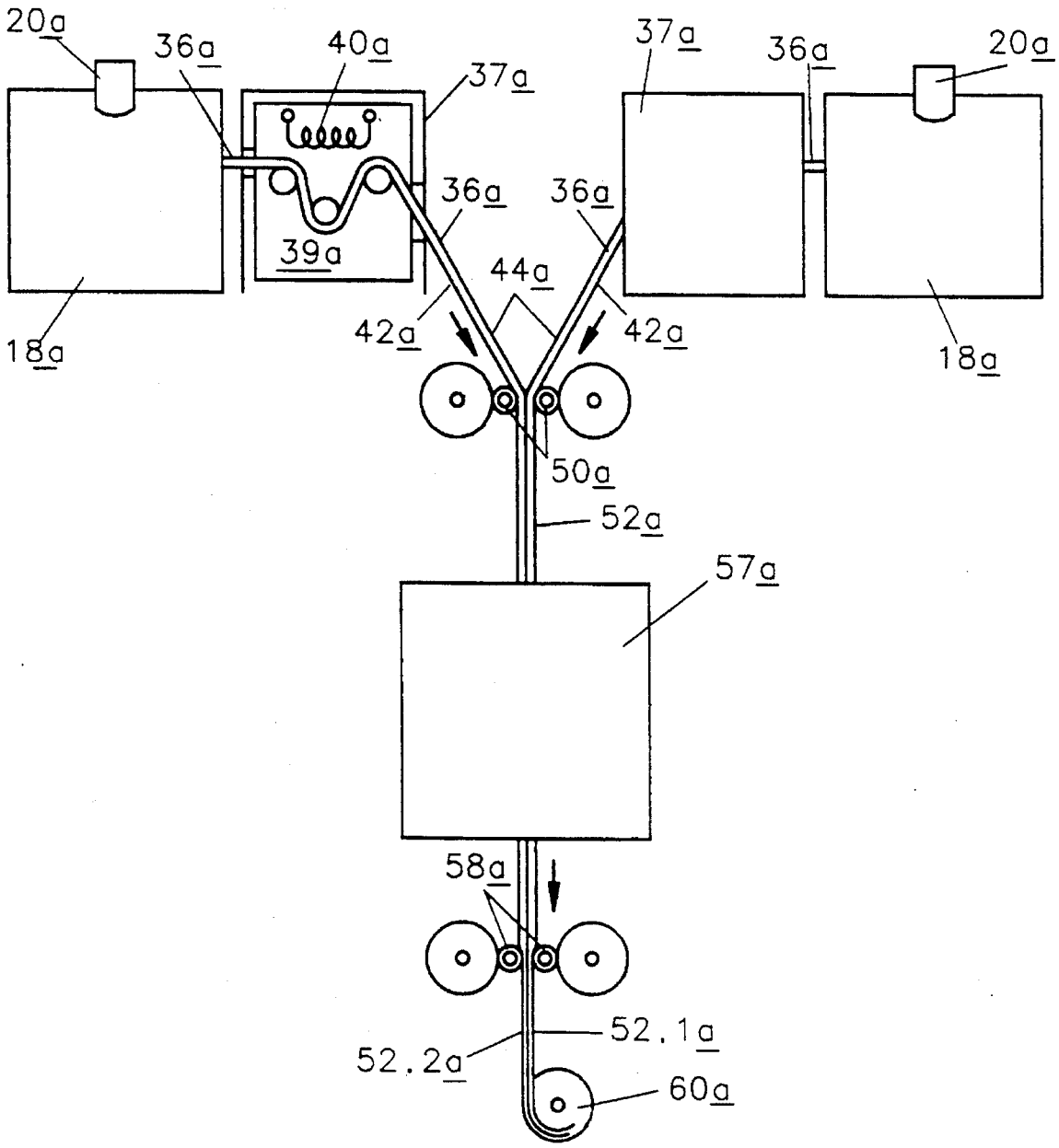
FIG. 9 is a diagrammatic view similar to FIGS. 1 and 2 illustrating an alternate embodiment of the method of the invention.

In an alternate preferred embodiment of the method of the invention as illustrated in FIG. 9, wherein corresponding apparatus or components are identified with corresponding reference numerals, metal foil preforms **36*a* are formed in-line with means 40*a* for heat-treating the preforms for removal of residual stress, with pressure bonding rolls 50*a* for solid-phase metallurgically bonding the preforms together, with solution-heat treated means 57*a* for producing fine-grained foil materials, and with final rolling means 58*a* to provide a metal foil 52*a* of improved density and strength and of the desired final thickness. The foil is coiled on take-up reel 60*a*. In this alternate preferred embodiment, the heat-treatment means are operated in-line (as illustrated for the heat-treat means 40*a*) at temperatures in the range from 900° to 1100° C. and from 900° to 1100° C. respectively for 1 to 2 minutes as in the previously described method and the preforms 36*a* are metallurgically bonded to each other in the solid phase and consolidated with each other at room temperature. In this way, the method of the invention as illustrated in FIG. 9 provides metal foils 52*a*** with increased economy and efficiency.

EXAMPLE I

In one exemplary embodiment of the invention, a high strength titanium alloy powder material having particle sizes in the range from –40 to 200 mesh size and a nominal composition of 6 percent aluminum, 4 percent vanadium, and the balance titanium by weight (Ti-Al6-V4) is fed to a plasma spray apparatus and plasma-deposited on a receiving surface. The powder material which was used included 0.030 percent carbon, 0.0036 percent hydrogen, 0.0095 percent nitrogen and 0.018 percent oxygen by weight as impurities. The deposited material is peeled from the receiving surface to form a metal foil preform having a thickness of about 0.014 inches having a relatively smooth side as-cast against the receiving surface and a relatively rough, opposite or free side. The preform material as plasma deposited was found to include 0.041 percent carbon, 0.0124 percent hydrogen, 0.012 percent nitrogen, 0.22 percent oxygen, 6.15 percent aluminum, 3.80 percent vanadium, and the balance titanium by weight analysis. The preform material is coiled, preferably with a molybdenum separator between convolutions, and is heated to a temperature of about 1000° C. for 60 minutes in a vacuum or an argon atmosphere to remove residual stress. Two of the metal foil preforms are then advanced with the relatively rough surfaces thereof in facing engagement between pressure bonding rolls at room temperature and are squeezed together with a reduction in overall thickness of about 15 percent for metallurgically bonding the preform materials to each other in the solid phase to form a metal foil and for consolidating the preform materials. The metal foil is solution annealed at 1050° C. for 60 minutes in a vacuum or an argon atmosphere. The annealed foil is reduced by cold, pressure rolling by about 10 percent in each pass for a series of passes with intermediate solution anneals as above described to reduce the foil thickness to 0.0043 inches. The metal foil as finally produced is found to include 0.053 percent carbon, 0.0051 percent hydrogen, 0.013 percent nitrogen and 0.290 percent oxygen by weight as impurities. That composition corresponds to a commercially available Ti-Al6-V4 wrought foil produced ingot metallurgy having 0.10 percent carbon, 0.015 percent hydrogen, 0.05 percent nitrogen, 0.20 percent oxygen, 6 percent aluminum, 4 percent vanadium and the balance titanium by weight analysis. The metal foil displayed a modulus 15.6 (Msi), 0.2 percent yield strength (Ksi) of 133.7 an ultimate tensile strength (Ksi) of 136.2, an elongation of 7.8 percent, a Vickers hardness (HV) of 325, and 180° bend ductility (r/t) of 2.0 as compared to a wrought foil prepared by ingot metallurgy having a modulus of 14.5, 0.2 percent yield strength of 118.1, ultimate tensile strength of 126.4, elongation of 16.5 percent, a Vickers hardness of 325 and a 180° bend ductility of 3.3.

EXAMPLE II

In another embodiment of the invention, a titanium aluminide powder material having a particle size in the range from −40 to 200 mesh size and a nominal composition of 14 percent aluminum, 21 percent niobium and the balance titanium by weight (Ti-14-21) is fed to a plasma spray apparatus and plasma-deposited on a receiving surface. The deposited material is peeled from the receiving surface to form a metal foil preform having a thickness of about 0.014 inches having a relatively smooth side as-cast against the receiving surface and a relatively rough opposite or free side. The preform material was found to include 0.018 percent carbon, 0.0172 percent hydrogen, 0.021 percent nitrogen, 0.161 percent oxygen, and 0.048 percent iron by weight as impurities. The preform material is coiled, preferably with a molybdenum separator between convolutions, and is heated to a temperature of about 1000° C. for 60 minutes in a vacuum or an argon atmosphere to remove residual stress. Two of the metal foil preforms are then advanced with the relatively rough surfaces thereon in facing engagement between pressure bonding rolls at room temperature with a reduction in overall thickness of about 15 percent for metallurgically bonding the preform materials to each other in the solid phase to form a metal foil and for consolidating the preform materials. The metal foil is solution annealed at 1050° C. for 60 minutes in an argon atmosphere. The annealed foil is reduced by cold pressure rolling by about 10 percent in each pass for a series of passes with intermediate solution anneals as above described to reduce the foil thickness to 0.0043 inches. The metal foil is found to include 0.029 percent carbon, 0.0006 percent hydrogen, 0.017 percent nitrogen, 0.178 percent oxygen, 15.4 percent aluminum, 20.4 percent niobium and the balance titanium by weight analysis. That composition corresponds to a commercially available Ti-14-21 wrought foil produced by ingot metallurgy having less than 0.02 percent carbon, 0.001 percent hydrogen, 0.008 percent nitrogen, 0.08 percent oxygen, 14.4 percent aluminum and 22.1 percent niobium and the balance titanium by weight analysis. The metal foil displayed a modulus of 9.7 (Msi), 0.2 percent yield strength (Ksi) of 78.9, an ultimate tensile strength (Ksi) of 83.9, an elongation of 5.9 percent, a Vickers hardness (HV) of 250, and 180° bend ductility (r/t) of 3.0 as compared to a wrought foil prepared by ingot metallurgy having a modulus of 9.2, 0.2 percent yield strength of 51.0, ultimate tensile strength of 71.3, elongation of 8.8 percent, a hardness of 230 and a 180° bend ductility of 8.0.

It should be understood that although preferred embodiments of the foils and methods of the invention are described by way of illustrating the invention, metal foils of other than titanium-based materials are within the scope of the invention and the invention includes all modifications and equivalents of the disclosed embodiments falling within the scope of the appended claims.

We claim:

1. A method for making a metal foil comprising the steps of providing two plasma-deposited metal foil preforms each having a relatively smooth side as cast against a receiving surface and a relative rough opposite side with a microstructure that is not as fine as the relatively smooth side as plasma-deposited, pressing the metal foil preforms together with the two relatively rough sides thereof in facing engagement to metallurgically bond the preforms to each other and to consolidate materials of the preforms to form a metal foil and solution annealing the metal foil in a protective atmosphere to reduce grain size and improve ductility in the metal foil.

2. A method according to claim 1 wherein different plasma-deposited metal materials are embodied in the two metal preforms for forming a composite metal foil.

3. A method for making a metal foil selected from the group consisting of titanium aluminide and high strength titanium alloy materials comprising the steps of plasma-depositing metal material selected from the group consisting of titanium aluminide and high strength titanium alloy materials on a receiving surface, separating the plasma-deposited metal material from the receiving surface to form two metal foil preforms each having one relatively smooth side surface as-cast against the receiving surface and a relatively rough opposite side surface as plasma-deposited, and pressure rolling the two metal foil preforms together with the relatively rough sides thereof in facing engagement with each other to metallurgically bond materials of the metal foil preforms to each other with solid phase metallurgical bonds and to consolidate the materials of the metal foil preforms with each other to form a metal foil, and solution annealing the metal foil in a protective atmosphere to reduce grain size and improve ductility in the metal foil.

4. A method according to claim 3 wherein the metal foil preforms are pressure rolled together at room temperature in an air atmosphere.

5. A method according to claim 4 wherein the metal foil preforms are heated in a protective atmosphere for removing residual stresses from materials of the preforms prior to pressure rolling the two metal preforms together.

6. A method for making a titanium aluminide metal foil comprising the steps of plasma-depositing titanium aluminide metal material on a receiving surface, separating the plasma-deposited metal material from the receiving surface to form two metal foil preforms each having one relatively smooth side surface as-cast against the receiving surface and having a relatively rough opposite side surface, heating the metal foil preforms to a temperature in the range from 900° to 1100° C. in a protective atmosphere to remove residual stress from the preforms, pressure rolling the two metal foil preforms together in air at room temperature with relatively rough sides thereof in facing engagement with each other to metallurgically bond materials of the metal foil preforms to each other with solid phase metallurgical bonds and to consolidate materials of the metal foil preforms to form a metal foil, and solution annealing the metal foil at a temperature in the range from 900° to 1100° C. in a protective atmosphere, thereby to provide a substantially fully dense titanium aluminide metal foil.

7. A method for making a high strength titanium alloy metal foil comprising the steps of plasma-depositing a high strength titanium alloy metal material on a receiving surface, separating the plasma-deposited metal material from the receiving surface to form two metal foil preforms each having one relatively smooth side surface as-cast against the receiving surface and having a relatively rough opposite side surface, heating the metal foil preforms to a temperature in the range from 900° to 1150° C. in a non-oxidizing protective atmosphere to remove residual stress from the preforms, pressure rolling the two metal foil preforms together in air at room temperature with the relatively rough sides thereof in facing engagement with each other to metallurgically bond materials of the metal foil preforms to each other with solid phase metallurgical bonds and to consolidate materials of the metal preforms to form a metal foil, and solution annealing the metal foil at a temperature in the range from 900° to 1150° C. in a non-oxidizing protective atmosphere, thereby to provide a substantially fully dense high strength titanium alloy metal foil.

* * * * *